United States Patent [19]

Walmer

[11] 4,018,001

[45] Apr. 19, 1977

[54] DOLL HOUSE

[76] Inventor: Harry E. Walmer, 721 N. Overlook Drive, Alexandria, Va. 22305

[22] Filed: Sept. 23, 1975

[21] Appl. No.: 615,896

[52] U.S. Cl. ..... 46/19

[51] Int. Cl.[2] ..... A63H 3/52

[58] Field of Search ..... 46/18, 19, 20, 21, 12, 46/13; 312/109, 138 R, 265, 257 R; 35/16

[56] References Cited

UNITED STATES PATENTS

| | | | |
|---|---|---|---|
| 755,593 | 3/1904 | Durr | 312/138 R |
| 1,316,690 | 9/1919 | Crosby et al. | 46/19 |
| 1,631,622 | 6/1927 | Cleveland | 312/109 |
| 1,787,978 | 1/1931 | Gilmond | 46/18 |
| 2,036,802 | 4/1936 | Fleishman et al. | 46/12 |
| 3,020,601 | 2/1962 | Stambaugh et al. | 46/19 X |
| 3,430,386 | 3/1969 | Sandin et al. | 312/109 |
| 3,906,659 | 9/1975 | Walmer | 46/19 |

OTHER PUBLICATIONS

Fraser, "A History of Toys"—Delacorte Press, 1966, p. 94.

*Primary Examiner*—F. Barry Shay
*Attorney, Agent, or Firm*—M. Ted Raptes

[57] ABSTRACT

The invention relates to a doll house having a unique front wall, which is split and hinged to side walls, and which can be opened to expose the rooms within. The doll house is of the collapsible type having a novel design in its construction. It is constructed of a small number of individual panels which comprise the walls, floors, roof, etc. The panels are provided with grooves and slots so that all the panels slide and fit together easily and support one another. No tools or screws are required for construction and the parts are locked tightly together in a rigid structure by the simple insertion of several small pegs in matching holes provided in the various panels.

6 Claims, 12 Drawing Figures

DOLL HOUSE

BACKGROUND OF THE INVENTION

This invention relates to a doll house or toy house of the knock-down or collapsible type of simplified construction, capable of being easily constructed or taken apart. A unique design provides a front wall which comprises two sections hinged to side walls, permitting opening of the front of the house to expose the rooms within.

There have been developed various types of doll houses to provide recreation and education to children and adults. Many of these doll houses are of the permanent type presenting problems with respect to shipping and storage. Others, which are of the knock-down type are relatively complicated in construction and require various types of fasteners and locking members to hold the doll house together. These doll houses, for the most part require tools and screws for construction and lack the desired rigidity when constructed. Furthermore, more sturdy types of doll houses, which can be easily knocked-down, are desired by various adult hobbyists. These doll houses are required to have open access to the various floors in order that the hobbists can set up various furniture arrangements, etc. Interior decorators also find the doll houses useful in planning the furniture arrangements, etc., of rooms. In particular, a doll house having a front wall, easily opened, has not been easy, heretofore, to construct in a knock-down type.

BRIEF SUMMARY OF THE INVENTION

Generally, the present invention provides a unique front opening wall design style of a knock-down construction for a doll house. The doll house is also constructed with a unique roof design and a small number of panels provided with grooves and slots so that all parts slide together easily and support one another. A front wall in the front of the house is split into two hinged sections, which can be opened or closed and are easily assembled. The entire doll house assembles easily in minutes using no tools or screws, and once assembled, all the parts are locked tightly together to provide a rigid, sturdy structure by the simple insertion of several small pegs strategically arranged with respect to the structure of the doll house.

It is, therefore, an object of this invention to provide a doll house having a unique front wall construction design, capable of being easily constructed without special skill or the use of tools and fasteners, and which can be easily disassembled or knocked-down for storage or transport purposes.

Another object of this invention is to provide a doll house that is relatively rigid and sturdy in construction when assembled, requiring only simple pegs for holding the assembled house together.

A further object of this invention is to provide a doll house constructed from a novel arrangement of panels provided with grooves and slots whereby construction or disassembly of the doll house is facilitated.

Another object of this invention is to provide a unique front wall construction for a doll house whereby the front wall is comprised of two hinged sections held in place between a top beam and the first floor at the front of the doll house, and which are capable of being opened to expose the inner rooms of the doll house.

A further object of this invention is to provide a unique roof construction for the doll house.

Other objects, advantages and features of the invention will become apparent from the following detailed description of a preferred embodiment of the invention when considered with the accompanying drawings.

DETAILED DESCRIPTION OF THE INVENTION

Figure 1:
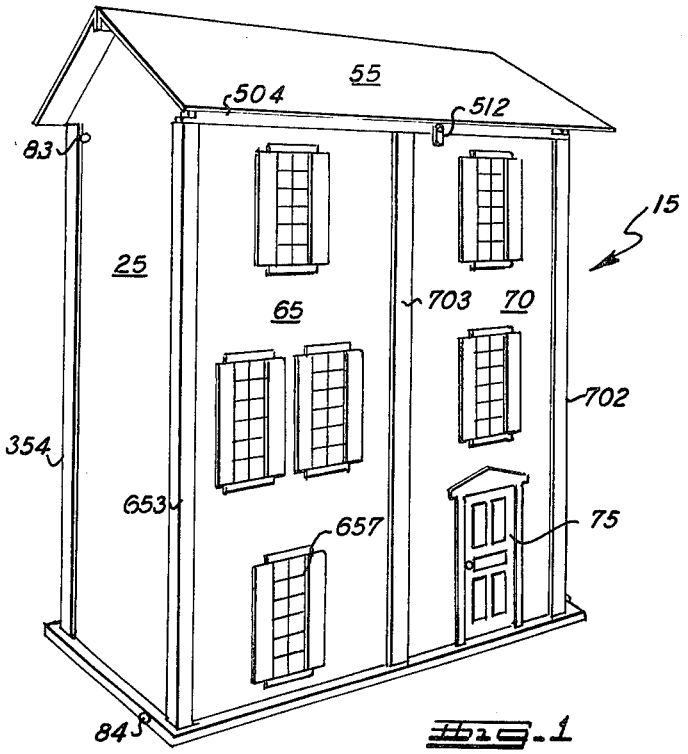
FIG. 1 is a perspective view of the front of the doll house as fully assembled embodying the novel aspects of the invention.
Figure 2:
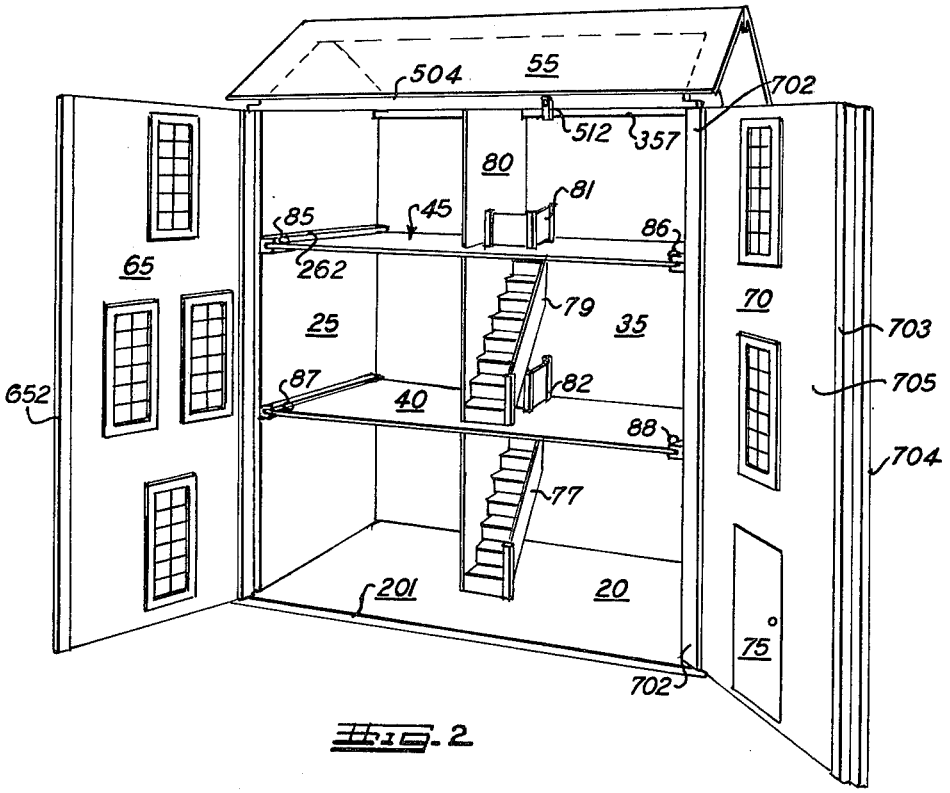
FIG. 2 is a perspective view of the front of the doll house fully assembled with the front wall sections opened disclosing the interior rooms thereof and details of the construction.
Figure 3:
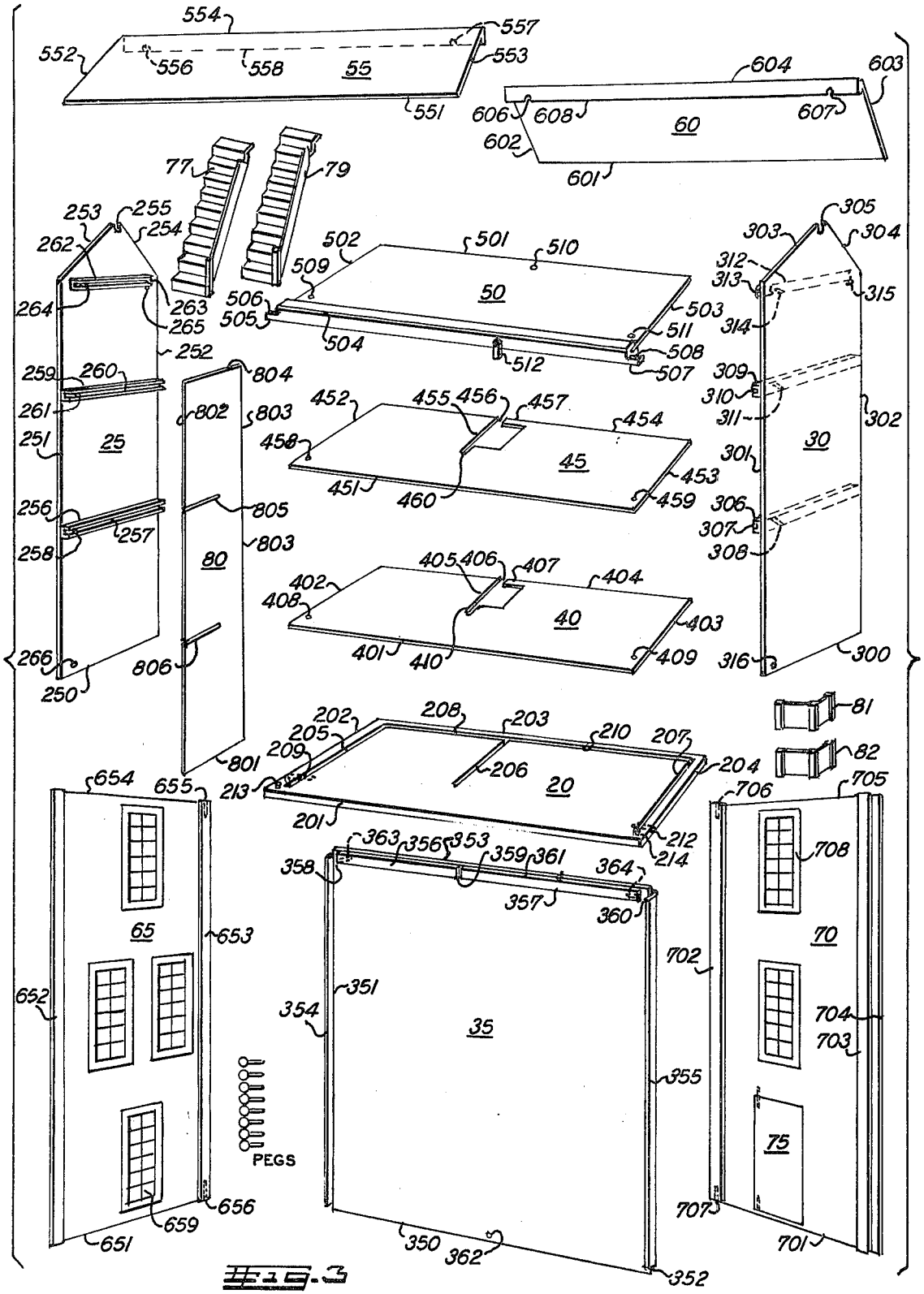
FIG. 3 is an exploded perspective front view as seen from the front, as in FIG. 2, disclosing the two sections of the front wall, rear, left and right side walls as well as the floors, roof, and various parts and details of the doll house.

Referring to the drawings, FIG. 1 shows a perspective view of the front of a doll house 15 embodying the principles of the invention and FIG. 2 shows a perspective front view of the doll house with the front wall sections opened disclosing the interior rooms thereof. Both views show the doll house fully assembled and ready for use as a recreational device or as a model house for display purposes with furniture arrangements, etc. FIG. 3 is an exploded perspective front view disclosing the manner in which the various parts are assembled together.

The doll house 15 comprises a rectangular base or first floor member 20 having edges 201, 202, 203 and 204, grooves 205, 206, 207 and 208 in the top surface, and upstanding pegs 213, 214 near the front edge 201.

A left side wall member 25 comprises bottom edge 250, front edge 251, rear edge 252, an integral second floor horizontal beam member 256 containing a groove 257, an integral third floor horizontal beam member 259 with groove 260, and an integral fourth floor horizontal beam member 262 with groove 263. The top portion of the left wall comprises slanted edges 253 and 254 with a slot 255 at the top. Similarly, a right side wall member 30 comprises bottom edges 300, front edge 301, rear edge 302, second floor horizontal beam member 306 with groove 307, integral third floor horizontal beam member 309 with groove 310, integral fourth floor horizontal beam member 312 with groove 313, and slanted edges 303 and 304 with slot 305.

A rear wall member 35 comprises top edge 353, bottom edge 350, left edge 351 and right edge 352, and integral, L-shaped left and right corner beam members 354 and 355. Across the top of the inside of the rear wall edge 353, horizontal beams 356 and 357 are disposed with slots 358, 359 and 360 disposed between the beams and the corner beam members 354 and 355.

An intermediate wall member 80 comprises front edge 802, rear edge 803, bottom edge 801, top edge 804, and horizontal slots 805 and 806.

A second floor member 40 comprises front edge 401, rear edge 404, left and right side edges 402 and 403, and stair well 405 having open end 406 and slot 410.

A third floor member 45 comprises a front edge 451, a rear edge 454, left edge 452, right edge 453, and stair well 455 having open end 456 and slot 460.

Figure 6:
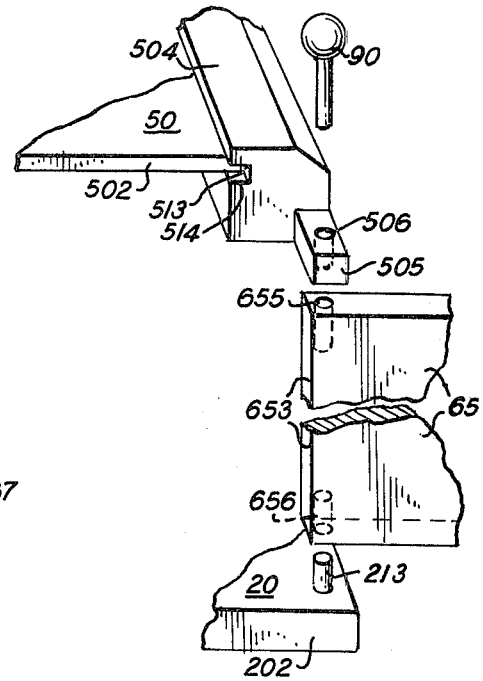
FIG. 6 is an exploded, enlarged, perspective, fragmentary view, with the roof and left wall removed, as seen from the left side, of the fourth floor, first floor and left front wall section of the left front corner of the doll house disclosing details of the assembly thereof.

A fourth floor member 50 comprises a rear edge 501 and left and right side edges 502 and 503. A front horizontal beam 504 is integral with front edge 513 which is disposed in groove 514 of the beam (FIG. 6). Beam 504 comprises left arm 505 and hole 506, and right arm 507 and hole 508.

Figure 4:
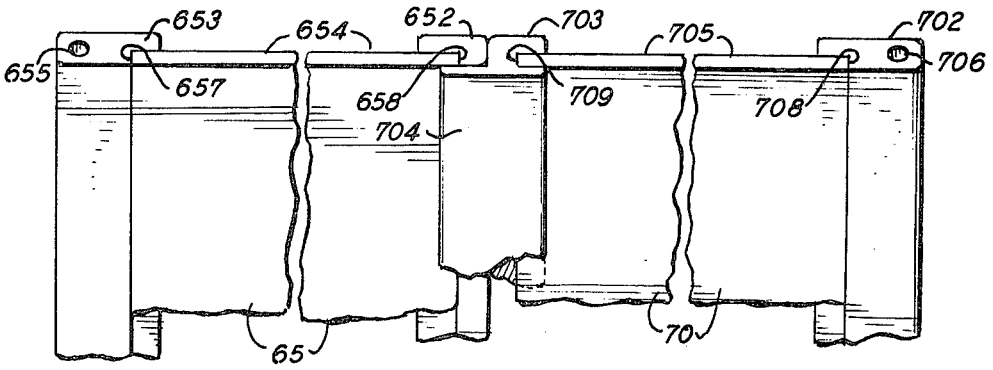
FIG. 4 is an enlarged top perspective view of the two sections of the front wall of the doll house in a closed position disclosing details thereof.
Figure 5:
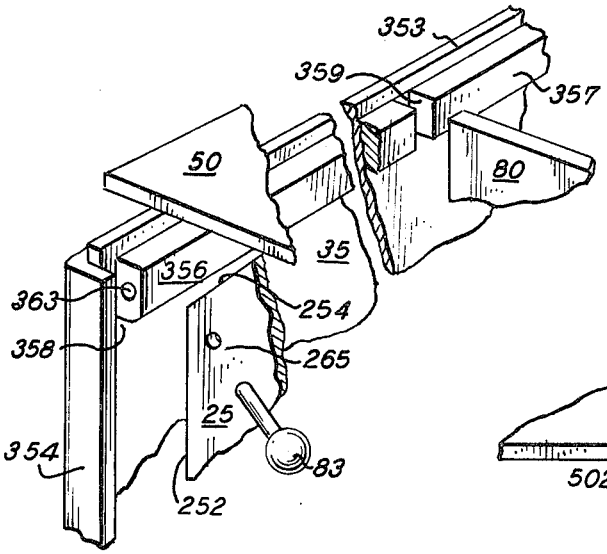
FIG. 5 is an exploded, enlarged, perspective, fragmentary view, with the roof removed, as seen from the left side of the left wall, rear wall, fourth floor, and center wall of the doll house disclosing details of the left rear corner and the assembly thereof.

The front wall of the doll house comprises two hinged sections, left front wall section 65 and right front wall section 70. Section 65 comprises bottom edge 651, top edge 654, and vertical beam 652 on edge 657 and beam 653 on edge 658 (FIG. 4). Beam 653 comprises holes 655 and 656 in the top and bottom sections. Similarly, section 70 comprises bottom edge 701, top edge 705, vertical beam 702 containing holes 706 and 707 disposed on edge 708 (FIG. 4) and vertical beam 703 disposed on edge 709. Beam 703 contains a lip section 704 adapted to overlap the outer portion of beam 652 when the two front wall sections are closed. Simulated windows such as 659 and 708 are disposed in both front wall sections 65 and 70. A door 75 is disposed in section 70 at the first floor level.

A front roof member 55 comprises bottom edge 551, left and right side edges 552 and 553, and a top beam member 554 with edge 558 having slots 556 and 557. A similar rear roof member 60 comprises bottom edge 601, left and right side edges 602 and 603, and a top beam member 604 with edge 608 having slots 606 and 607.

Figure 12:
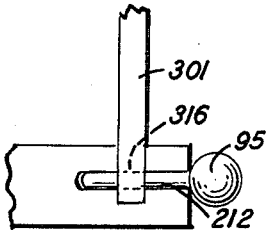
FIG. 12 is an enlarged fragmentary front section view of the assembly with the right front wall section removed of the first floor and the right side wall disclosing details of how they are held together by a peg.

The various members of the doll house are adapted to be assembled together and held together with pegs. The bottom edge 350 of rear wall 35 is inserted in groove 208 of the first floor 20, and edges 250 and 300 of side walls 25 and 30 are inserted in grooves 205 and 207, respectively. The rear edges 252 and 302 of side walls 25 and 30 each fit within left corner beam member 354 and slot 358 and right corner beam member 355 and slot 360, respectively. The three walls are retained in place by inserting peg 84 (FIG. 1) in holes 266 and 209 of wall 25 and floor 20, and similarly, a peg 95 in holes 316 and 212 of wall 25 and floor 20 (see FIG 12); peg 83 in hole 265 of left wall 25, and hole 363 in the end of beam 356, and similarly, a peg (not shown) in hole 315 of right wall 30 and a hole 364 in the end of beam 357; and a peg (not shown) in hole 210 in the groove 208 of floor 20 and hole 362 of wall 35.

Figure 8:
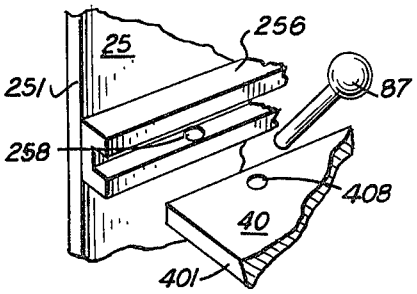
FIG. 8 is an exploded, enlarged, fragmentary, perspective view, with the left front wall section removed of the left side wall and second floor disclosing details of the assembly thereof.
Figure 9:
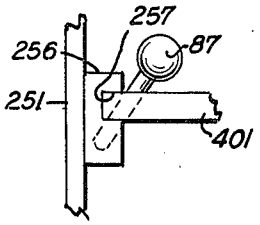
FIG. 9 is an enlarged fragmentary front plan view with the left front wall section removed of the assembled left side wall and second floor disclosing details of how they are held together by a peg.

Intermediate wall 80 is next inserted in groove 206 of floor 20, with rear edge 803 engaging slot 359 of rear wall 35. Second floor 40 is next assembled by sliding left and right side edges 402 and 403 simultaneously in beam grooves 257 and 307 of the side walls 25 and 30, respectively. The second floor is pushed forward until its rear edge 404 abuts against rear wall 35 and, in so doing, slots 410 and 806 are engaged. The second floor and intermediate wall are retained in place be inserting peg 87 in hole 408 of the second floor and hole 258 in beam 256 of the left side wall (see FIGS. 8 and 9), and, similarly peg 88 is inserted in hole 409 of the second floor and hole 308 in beam 306 of the right side wall 30.

The third floor 45 is installed similarly as second floor 40 by sliding left and right side edges 452 and 453 in grooves 260 and 310 of beams 259 and 309 respectively. Rear edge 454 abuts rear wall 35 and slots 460 and 805 are engaged. Peg 85 is inserted in holes 458 and 261, and peg 86 is inserted in holes 459 and 311.

Figure 7:
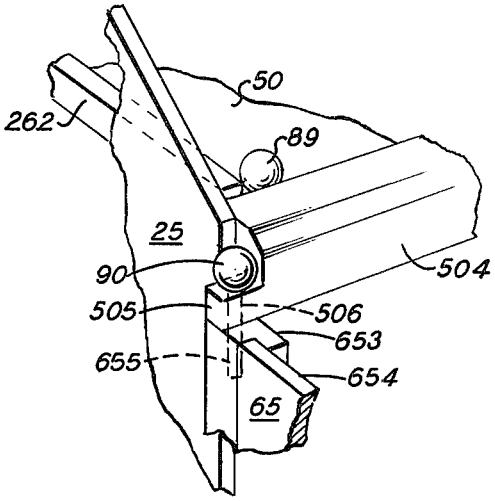
FIG. 7 is an enlarged, perspective, fragmentary view of the left front corner, of the left side wall, fourth floor top front beam, left front wall section, and fourth floor disclosing details of the assembly thereof.

The fourth floor 50 is next installed by sliding side edges 502 and 503 simultaneously in grooves 263 and 313 of beams 262 and 312 of side walls 25 and 30, respectively. The rear edge 501 abuts rear wall 35 and rests on the tops of beams 356 and 357. A peg 89 (see FIG. 7) is inserted in hole 509 of floor 50 and hole 264 in beam 262 of left side wall 25. Similarly, a peg (not shown) in inserted in hole 511 of floor 50 and hole 314 in beam 312 of right side wall 30. A peg (not shown) is also inserted in hole 510 at the rear of floor 50 and hole 361 in beam 357.

The front wall sections or doors 65 and 70 are next installed and hinged at the front of the doll house. Left section 56 is installed by engaging hole 656 at the bottom of beam 653 in peg 213 of floor 20, and lining up hole 655 at the top of beam 653 with hole 506 in arm 505 of beam 504. A peg 90 is inserted in aligned holes 655 and 506 to thereby secure section 65 and provde means for pivoting the section to permit opening or closing thereof (see FIGS. 6 and 7). Right front wall section 70 is similarly installed by engaging hole 707 of beam 702 in peg 214, aligning hole 706 with hole 508 of arm 507 and inserting a peg (not shown) in the aligned holes. The two front wall sections 65 and 70, being hinged and pivotable, are thus capable of being opened to expose the interior rooms of the doll house or being closed to form a front wall which is flush between the first floor and the bottom of beam 504. When closed, as shown in FIGS. 1 and 4, the lip 704 overlaps beam 652 to provide a pleasing appearance to the front of the doll house. In order to secure the sections 65 and 70 in a closed position, a swivel member 512 is provided on the outside of beam 504, which can be turned across the upper face of section 70.

The rear roof member 60 is next installed by inserting the slots 606 and 607 of edge 608 of the beam 605 in slots 255 and 305 of the left and right side walls, respectively. The inner surface of the roof rests on the rear slanted edges 254 and 304 of the left and right side walls, respectively. Similarly, the slots 556 and 557 of edge 558 of the front roof beam 554 are installed in slots 255 and 305, and the roof member 55 rests on front slanted edges 253 and 303 of the left and right side walls, respectively.

The placement of the pegs for holding the doll house together is uniquely designed for easy assembly as well as providing the rigidity required for the doll house. For the most part, a triangular arrangement is provided for the pegs, e.g., pegs 83, 84 and 95 form a triangular arrangement; pegs 84, 95, and the peg (not shown) in holes 315 and 364 form a triangular arrangement; pegs 87, 88, and the peg (not shown) in holes 210 and 362 also form a triangular arrangement; and other similar arrangements.

Figure 11:
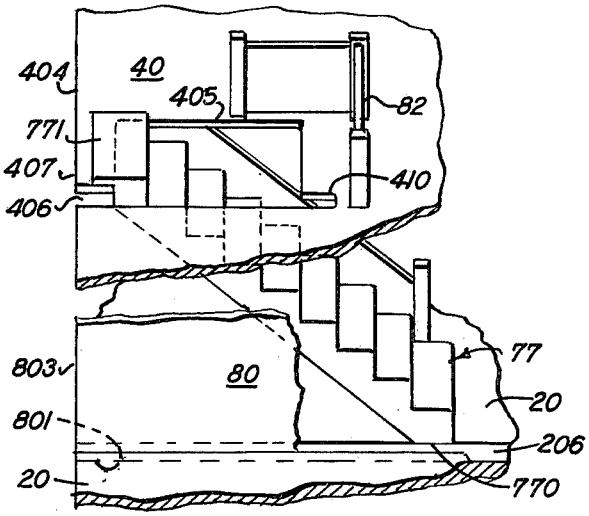
FIG 11 is an enlarged fragmentary perspective view of the assembled staircase between the first and second floor members.

As shown in FIGS. 2 and 11 unitary staircases 77 and 79 are installed between the first and second floors, and between the second and third floors against intermediate wall 30. The bottom 770 of staircase 77 rests on the first floor 20 and an upper end 771 extends through the stair well 405 and rests on ledge 407. A protective L-shaped handrail 82 is also provided around the stair well. Similarly, staircase 79 is installed with handrail 81.

Figure 10:
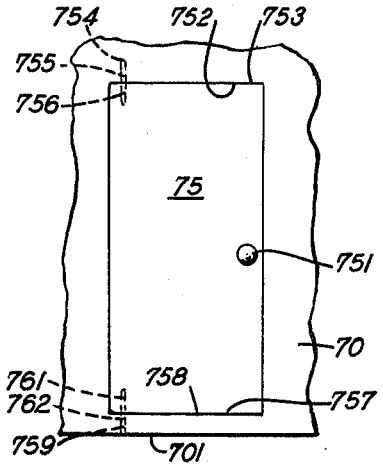
FIG. 10 is an enlarged front plan view of the door assembly in the right front wall section at the first floor.

In FIG. 10, a novel means for installing a door 75 in a doorway 752 in the front wall section 70 is provided. The door 75 has an upwardly extending pin 754 in a hole 756. The door is angled flush into the top of the doorway and the end of pin 754 marks a point on the underside of the top of the doorway where a hole 755 is drilled, after the door is removed. Pin 754 is inserted in hole 755 and the door is thereby able to be installed flush in the doorway. Two holes, one 761 in door 75 and another 762 in wall 70 are drilled simultaneously up through the bottom edge 701 of wall 70. Pin 759 in inserted first in hole 762 and then hole 761 to secure the door in the doorway. This procedure assures alignment of the holes and flushness of the door in the doorway.

Peg 751 has pin (not shown) which extends through a hole (not shown) of the door and a similar peg (not shown) is inserted on the end of the pin which protrudes through the hole of the door. Thus, a simulated door knob is provided.

The doll house is knocked-down or disassembled by reversing the above procedure. The unique and novel design provides the benefits of knock-down construction. The use of grooves and slots provide means for easily sliding the various parts together, which support one another. The doll house is rigid in construction and all parts are held together tightly by the simple insertion of a relatively small member of strategically arranged small pegs. When disassembled, the parts of the doll house can be stacked together for easy storage or shipment.

Although the doll house of this invention has been disclosed heretofore as the preferred embodiment, wherein six rooms are available by using one intermediate wall member 80, it is understood that the doll house can be constructed to contain more than one intermediate wall members thus providing a greater number of rooms. It is also contemplated within the invention that only one floor member such as 40 can be used to provide the doll house with fewer rooms.

What is claimed is:

1. An easily assembled knock-down doll house having a front wall capable of being opened to expose the interior rooms thereof, the parts of which are fitted together and held together only with pegs comprising:

a. a generally rectangular first floor member comprising left, right, and rear grooves in the top surface thereof, at least one intermediate groove parallel to said left and right grooves, and a pair of upstanding peg means in the left and right front corners;

b. a rear wall member having a size and shape adapting it to have its bottom edge engage said rear groove of said first floor member, comprising vertical L-shaped side beams and a top horizontal beam member disposed on the inner front wall containing at least one vertical slot;

c. left and right side wall members having respective sizes and shapes adapting them to have their rear edges engage said L-shaped beams of said rear wall and their bottom edges engage said respective left and right grooves of said first floor; each of said side walls containing a top, inner horizontal beam member having an inward side groove, at least one inner horizontal beam member having an inward side groove disposed between said top beam and the lower edge of said wall; each of said side walls comprising inwardly angled top edges, and a slot disposed at the terminus of said angled top edges;

d. at least one intermediate wall member having a size and shape adapting it to have its lower edge engage a respective said intermediate groove in said first floor and a said vertical slot of said rear wall top beam member, comprising at least one intermediate horizontal slot extending rearwardly from the front edge;

e. at least one intermediate floor member having a size and shape adapting it to have its side edges engage said grooves of said horizontal beam members of said side walls and comprising a stairwell near the rear edge porion thereof containing an opening to said rear edge and at least one horizontal slot extending forwardly from the rear edge, said slot being positioned to register with a said horizontal slot of said intermediate wall member;

f. a top floor member having a size and shape adapting it to have its side edges engage said grooves of said top horizontal beam member of said side walls, and comprising a top horizontal beam member disposed across the front edge of said top floor, arm members containing hole means extending from each of the end extremities of said top floor beam members;

g. front and rear roof panels each comprising a horizontal beam member disposed along the underportion of one edge containing a slot near each end, said roof panels being constructed and arranged to adapt said roof beams to enter said terminus slots of said side walls and the slots thereof to receive the edges of said terminus slots, said respective roof beams disposed adjacent to each other and said panels disposed along said angled edges of said side walls;

h. front wall means comprising left and right sections, said left section comprising left and center vertical beams disposed at the vertical edges thereof, said left vertical beam comprising vertical hole means in the top and bottom ends; said right section comprising right and center vertical beams disposed at the vertical edges thereof, said right vertical beam comprising vertical hole means in the upper and lower ends; said left and right sections having respective sizes and shapes adapting them to have said respective bottom vertical holes engage said respective upstanding pegs of said first floor members, and retaining means adapted to be disposed through said respective top holes when aligned with respective holes in said arm members of said top floor beam member, whereby said left and right sections can be opened and closed across the front of said doll house;

i. a plurality of pegs having respective sizes and shapes adapting them to be inserted in holes contained in said beams, grooves, wall and floor members at their junctures with each other for retaining said assembled structure together.

2. The doll house of claim 1 wherein said intermediate floor members comprise second and third floor members.

3. The doll house of claim 1 wherein there is only one intermediate wall member.

4. The doll house of claim 1 wherein said right section center beam comprises lip means having a size and shape adapting it to overlap said left section center beam when said sections are closed.

5. The doll house of claim 1 wherein a removable staircase having a size and shape adapting it to be disposed between said first and second floor members in said stairwell.

6. The doll house of claim 1 wherein said front wall contains a door installed within a doorway, said door comprising a first pin disposed in a hole in its upper edge, said first pin also engaging a predrilled hole in an upper edge of said doorway, a second pin disposed through simultaneously drilled holes through a lower edge of said doorway and the lower edge of said door, whereby said door is adapted to be mounted flush in said doorway and capable of being opened or closed.

* * * * *